US006669582B1

(12) United States Patent
Beeler

(10) Patent No.: US 6,669,582 B1
(45) Date of Patent: Dec. 30, 2003

(54) GLOVE MOUNTED TARGET DEVICE AND METHOD FOR AIDING A PLAYER IN ACCURATELY THROWING A BASEBALL

(76) Inventor: Roscoe Beeler, 2520 Peritan Rd., Virginia Beach, VA (US) 23454

( * ) Notice: Subject to any disclaimer, the term of this patent is extended or adjusted under 35 U.S.C. 154(b) by 0 days.

(21) Appl. No.: 09/574,922

(22) Filed: May 19, 2000

(51) Int. Cl.[7] ..... A63B 69/00; A63B 59/10; A41D 13/08; A41D 19/00

(52) U.S. Cl. ..... 473/458; 473/422; 273/348; 2/19; 2/161.1

(58) Field of Search ..... 473/205, 422, 473/450, 458, 464, FOR 102, FOR 103, FOR 106; 2/16–20, 161.1–161.7, 19; D29/115, 112, 123; 128/DIG. 15, 878–880; 273/348.4

(56) References Cited

U.S. PATENT DOCUMENTS 2,662,225 A * 12/1953 Wheeler ..... 2/19
3,898,696 A * 8/1975 Campanis ..... 2/19
3,999,748 A * 12/1976 Clarke ..... 273/348.4
4,235,042 A * 11/1980 Hills ..... 273/DIG. 30
4,384,416 A * 5/1983 Kanzelberger ..... 40/661
4,836,554 A * 6/1989 Robbins ..... 473/508
4,863,239 A * 9/1989 Malone ..... 2/160
5,584,133 A * 12/1996 Motooka et al. ..... 2/160

* cited by examiner

*Primary Examiner*—Paul T. Sewell
*Assistant Examiner*—Mitra Aryanpour
(74) *Attorney, Agent, or Firm*—Robert Nathans

(57) ABSTRACT

A generally circular, thin, laminated, high color contrast, flexible target sheet member is affixed to a central pocket portion of a baseball glove by a peel-away pressure sensitive formed upon the backing of the target member. This simple and inexpensive single (one piece) targeting member can be mail-ordered or otherwise sold directly, particularly to millions of young "Little League" players in need of an aid in improving their throwing accuracy. No detrimental modifications of the gloves already in possession of the players is required. An advertising logo of a sponsor can be added, enabling its use as a give-away item. Alternatively, a team logo can be printed on the target.

1 Claim, 1 Drawing Sheet

GLOVE MOUNTED TARGET DEVICE AND METHOD FOR AIDING A PLAYER IN ACCURATELY THROWING A BASEBALL

BACKGROUND OF THE INVENTION

The present invention relates to the field of baseball.

The use of colored target portions formed upon a baseball glove to enhance accuracy in aiming a baseball at a player wearing the glove has been suggested long ago in the prior art. In U.S. Pat. No. 2,662,225 issued to Wheeler in 1953, an oil filled pocket, provided for another purpose, is built into the glove, and Wheeler briefly suggests that if the oil itself does not produce sufficient contrast on the cover of the glove, coloring matter may be applied to the pocketed oil filled area to produce a desired visual contrast for targeting purposes. In U.S. Pat. No. 3,898,696 issued to Campanis in 1975, a target is formed upon manufacture of the glove by affixing two separate marginal members, each affixed to a catcher's glove, to create a U-shaped area having a bright contrast and surrounding a central glove portion.

These approaches create problems for the manufacturers as they increase the manufacturing costs of the gloves due to added complexity, and what is perhaps more important, is that having an optional, additional type of glove bearing the target members, impedes marketing of the gloves, since this causes distributors and retailers to maintain and monitor inventories for two types of gloves rather than one. This may explain why these types of gloves have presumably not been sold in the marketplace.

BRIEF SUMMARY OF A PREFERRED EMBODIMENT OF THE INVENTION

The aforesaid disadvantages of the prior art approaches set forth above are eliminated by providing a relatively simple and inexpensive single or one-piece target device that can be marketed directly to persons that already have new or old gloves in their possession, by mail order or otherwise.

The invention aids a first player in accurately throwing a baseball at a glove of a second player and comprises the steps of supplying a thin, flexible, generally circular, one piece target member, separate from the glove, to a young player in previous possession of a glove, the target member having an outwardly facing portion having a color providing a high visual contrast with respect to the color of the remaining portions of the glove, and an inwardly facing, pressure sensitive "peel away" adhesive layer, for affixing the target member to the glove by easily and rapidly pressing the target member against the central glove portion.

BRIEF DESCRIPTION OF THE DRAWINGS

The features of the invention will become more apparent upon reading of the following description, taken in conjunction with the drawings in which.

DETAILED DESCRIPTION OF A PREFERRED EMBODIMENT OF THE INVENTION

Figure 1:
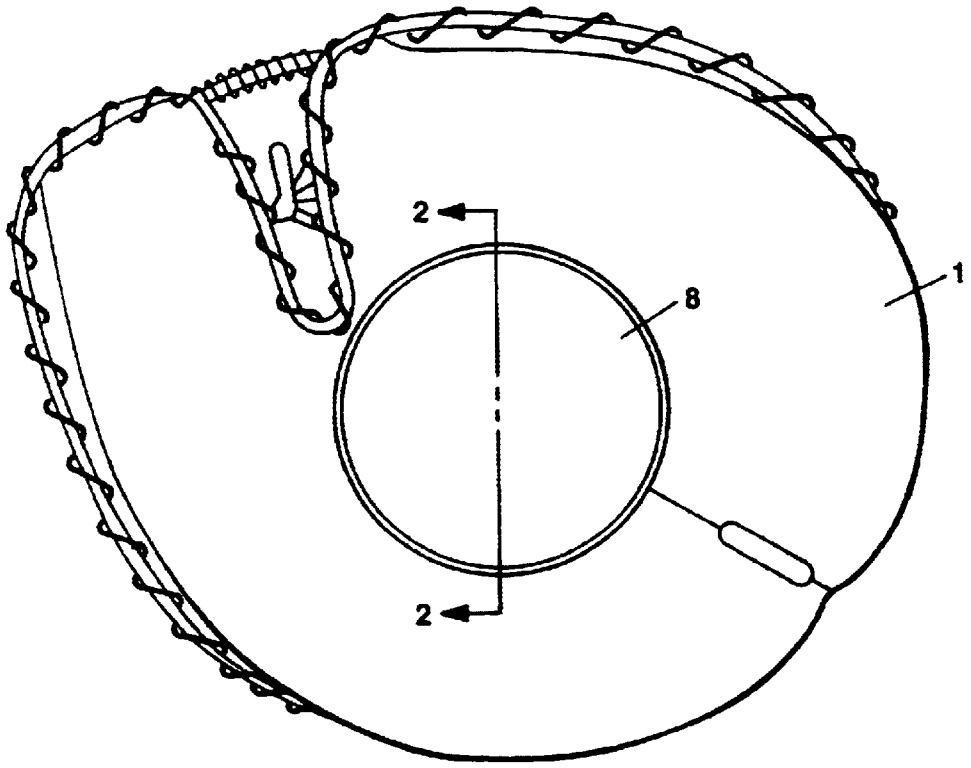
FIG. 1 shows the target member positioned within a catcher's mitt.
Figure 2:
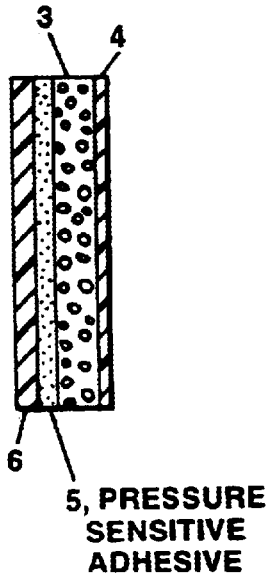
FIG. 2 shows a cross section of the target member.

As shown in FIG. 1, the aforesaid single, one piece target member 2 is positioned within a central portion of a catcher's mitt or glove 1. In FIG. 2, a cross section of the target member is illustrated, having an interior foam body portion or layer 3 with an outwardly facing brightly colored plastic layer 4 for producing a high visual contrast with the remaining portions of the glove. Preferably the coloring of layer 4 is of a luminous color such as bright orange, widely found on bumper stickers to enhance visibility from a distance.

Millions of young "Little League" players are greatly aided in their ball throwing abilities by having significant others, such as their parents, purchase the inexpensive target member, which can be easily and rapidly affixed to a catcher's mitt or any other mitt, such as a first, second or third baseman's mitt, by peeling away the protective plastic layer 6 to expose the pressure sensitive adhesive layer 5. The substantially circular target member 2 is then pressed against a central glove portion to cause it to be affixed to the glove as shown in FIG. 1. The use of such pressure sensitive adhesives are widespread. For example, flexible name ID badges are provided with the peel-away layer, and the exposed pressure sensitive adhesive is pressed against the clothing of the wearer of the temporary ID badge. The continual pounding of the ball against the flexible target member helps to retain it in place as it conforms to the glove due to its flexibility. This is enhanced due to the flexible nature of the inner foam body or interior layer 3, supporting the adhesive layers and the brightly colored layer 4. On the other hand, the "Sweet Spot" target member 2 can be peeled off if desired for cleaning. Also, the interior plastic foam portion of the laminated target member 3, due to its flexible springy nature, may help to absorb at least some of the shock of the ball striking the gloves, particularly well worn gloves. Advantageously, the target member can optionally bear a brightly colored advertising logo 8 on its outwardly facing surface. This may enable a sporting goods sponsor to provide the target member to "Little League" players as a give-away item.

Also, the teams logo could be printed on the "Sweet Spot" target member if desired. Thus, the target member doubles as a kind of moral boosting pennant.

Since variations of the foregoing will be apparent to workers in the art, the scope of the invention is to be limited solely by the terms of the following claims and art recognized equivalents thereof.

I claim:

1. A method for aiding a first player in throwing an ordinary baseball having a non-adhesive surface at a non-adhesive baseball receiving pocket portion of a glove held by a second player comprising;

(a) providing a single flexible target member, separate from said glove, said target member having a body portion and an outwardly facing portion for producing a high visual contrast with respect to portions of said glove positioned about said pocket portion, and an inwardly facing pressure sensitive adhesive layer, positioned upon an inwardly facing portion of said target member, for affixing the target member to said glove; and (b) thereafter affixing said single flexible target member to said pocket portion of said glove by manually pressing said inwardly facing pressure sensitive adhesive layer against the pocket portion of said glove and (c) wherein step (b) is performed by a user of the glove previously in possession of the glove.

* * * * *